US011001987B2

(12) United States Patent
Yamamitsu et al.

(10) Patent No.: US 11,001,987 B2
(45) Date of Patent: May 11, 2021

(54) CAB AND WORK MACHINE

(71) Applicant: KOMATSU LTD., Tokyo (JP)

(72) Inventors: Hironori Yamamitsu, Tokyo (JP); Naozumi Okura, Tokyo (JP); Masamichi Miyazaki, Tokyo (JP); Takashi Tsukamoto, Tokyo (JP)

(73) Assignee: KOMATSU LTD., Tokyo (JP)

( * ) Notice: Subject to any disclaimer, the term of this patent is extended or adjusted under 35 U.S.C. 154(b) by 92 days.

(21) Appl. No.: 16/590,778

(22) Filed: Oct. 2, 2019

(65) Prior Publication Data

US 2020/0109537 A1 Apr. 9, 2020

(30) Foreign Application Priority Data

Oct. 9, 2018 (JP) ..... JP2018-190976

(51) Int. Cl.
*B60J 7/00* (2006.01)
*E02F 9/16* (2006.01)

(52) U.S. Cl.
CPC ..... *E02F 9/163* (2013.01)

(58) Field of Classification Search
CPC .... B01D 27/08; B01D 27/106; B21D 19/088; B21D 28/34; B21D 53/24; E02F 9/163; E02F 9/261; E02F 9/16; E02F 9/26; B62D 33/0617
See application file for complete search history.

(56) References Cited

U.S. PATENT DOCUMENTS 5,524,429 A * 6/1996 Few ..... F02P 23/04 60/776
5,755,486 A * 5/1998 Wycech ..... B29C 70/78 296/187.02
6,209,949 B1 * 4/2001 Sakyo ..... B62D 21/09 296/190.08
2004/0104060 A1 * 6/2004 Mori ..... B62D 23/005 180/89.12
2007/0085380 A1 * 4/2007 Murakami ..... B62D 33/0617 296/190.08
2007/0278826 A1 * 12/2007 Sato ..... B60R 13/02 296/190.08
2009/0115223 A1 * 5/2009 Tsukamoto ..... B62D 33/0633 296/190.04
2010/0320804 A1 * 12/2010 Kamimae ..... E02F 9/163 296/190.08
2011/0121609 A1 * 5/2011 Hoefle ..... B62D 33/0617 296/190.08
2012/0146361 A1 * 6/2012 Nagami ..... E02F 9/163 296/190.09
2013/0127205 A1 * 5/2013 Jaynes ..... B62D 65/02 296/190.1
2014/0252803 A1 * 9/2014 Matsumoto ..... H01Q 1/3275 296/190.01

(Continued)

FOREIGN PATENT DOCUMENTS

JP 5524429 B1 6/2014

*Primary Examiner* — Kiran B Patel
(74) *Attorney, Agent, or Firm* — Global IP Counselors, LLP

(57) ABSTRACT

A cab is used in a work machine. The cab includes a first pillar, a second pillar disposed to a rear of the first pillar, a beam disposed between the first pillar and the second pillar, and a reinforcing member provided to the beam.

7 Claims, 9 Drawing Sheets

(56) References Cited

U.S. PATENT DOCUMENTS

| | | | | |
|---|---|---|---|---|
| 2014/0374186 | A1* | 12/2014 | Nagami | E02F 9/163<br>180/291 |
| 2015/0218778 | A1* | 8/2015 | Kimura | B60H 1/00378<br>296/190.09 |
| 2015/0218855 | A1* | 8/2015 | Kato | E05B 1/00<br>292/336.3 |
| 2015/0275479 | A1* | 10/2015 | Kitashou | B62D 33/0617<br>172/781 |
| 2015/0298748 | A1* | 10/2015 | Kitashou | E02F 3/765<br>296/190.08 |
| 2016/0207744 | A1 | 7/2016 | Uemura et al. | |
| 2016/0305091 | A1* | 10/2016 | Ikeda | E02F 9/0808 |
| 2017/0002543 | A1* | 1/2017 | Wada | E02F 9/163 |
| 2019/0077333 | A1* | 3/2019 | Abe | E02F 9/163 |
| 2019/0225468 | A1* | 7/2019 | Lemke | B66F 9/07545 |
| 2020/0023789 | A1* | 1/2020 | Erhardt | E02F 9/0858 |
| 2020/0048864 | A1* | 2/2020 | Orvegren | E02F 9/163 |
| 2020/0248431 | A1* | 8/2020 | Takaoka | E02F 9/166 |

* cited by examiner

CAB AND WORK MACHINE

CROSS-REFERENCE TO RELATED APPLICATIONS

This application claims priority to Japanese Patent Application No. 2018-190976 filed on Oct. 9, 2018, the disclosure of which is hereby incorporated herein by reference in its entirety.

BACKGROUND

Field of the Invention

The present invention relates to a work machine and a cab used in a work machine.

Background Information

Pipe layers, bulldozers, and the like are used as work machines, but these are manufactured by modifying a work machine based on a tractor, and from the standpoint of production cost it is preferable for the cab to be shared among multiple models.

The above-mentioned pipe layer is a vehicle in which a counterweight, a boom, and a winch are installed on a track-type tractor, and is used for laying pipelines that transport oil and natural gas (see, for example, Japanese Patent No. 5,524,429).

In addition, bulldozers are equipped with blades, rippers, etc., and are used for plowing up earth, raising the ground level, grading, and so forth.

The cabs used in work machines are equipped with a rollover protection structure (ROPS) to protect the occupant in the cab if it should tip over. The standard for a ROPS varies depending on the vehicle weight, and the greater is the vehicle weight, the stronger the structure needs to be.

A ROPS such as this can be a ROPS integrated type in which the cab itself includes a protective structure, or a portal frame type in which a frame is provided to cover the periphery of the cab and used as a protective structure. Since the portal frame impairs the operator's view of the work machine, the ROPS integrated cab is preferable from the standpoint of visibility.

SUMMARY

However, the weight of a bulldozer varies with the type of vehicle, and a pipe layer is heavier, so it is difficult to use a shared cab for work machines of multiple types and sizes with a ROPS integrated cab.

It is an object to provide a ROPS integrated cab that can be used for work machines of multiple types and sizes, as well as a work machine.

To achieve the stated object, the cab pertaining to an aspect of the invention is a cab used in a work machine, comprises a first pillar, s second pillar, a beam, and a reinforcing member. The second pillar is disposed to the rear of the first pillar. The beam is disposed between the first pillar and the second pillar. The Reinforcing member is provided to the beam.

The work machine pertaining to another aspect of the invention is equipped with a cab. The cab comprises a first pillar, a second pillar, and a beam. The second pillar is disposed to the rear of the first pillar. The beam is disposed between the first pillar and the second pillar. The beam has an inner plate, an outer plate, and a reinforcing member. The outer plate is disposed on the outside of the inner plate. The reinforcing member is disposed between the outer plate and the inner plate and is fixed to the inner plate.

The present invention provides a cab that can be used in various types and sizes of work machine, as well as a work machine.

DETAILED DESCRIPTION OF EMBODIMENT(S)

A pipe layer according to an embodiment of the present invention will be described below with reference to the drawings.

Overview of Configuration of Pipe Layer 1

Figure 1:
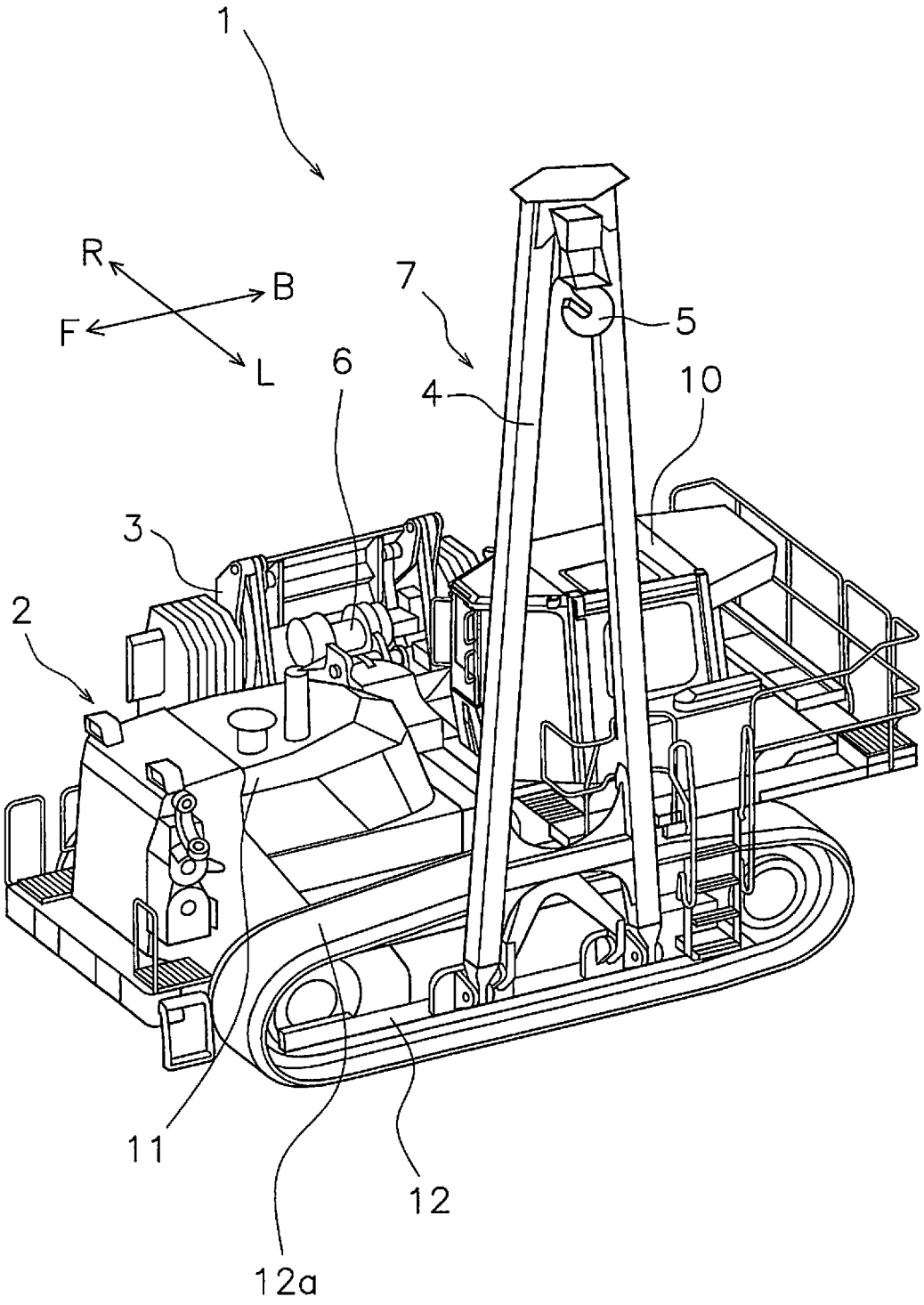
FIG. 1 is an oblique view of a pipe layer in an embodiment of the present invention.

FIG. 1 is an oblique view of a pipe layer 1 in this embodiment.

The pipe layer 1 comprises a vehicle body 2 and a work implement 7. The vehicle body 2 comprises a cab 10 that encloses and protects the operator and the controls used to operate the work implement 7. In the following description, "longitudinal direction" means the longitudinal direction of the vehicle body as viewed by an operator seated in the driver's seat of the cab 10. The term "left and right direction" or "to the side" refers to the vehicle width direction of the pipe layer 1, and is the left and right direction as viewed by the operator seated in the driver's seat of the cab 10. In FIG. 1, the forward direction is indicated by the arrow F, the backward direction is indicated by the arrow B, the right direction is indicated by the arrow R, and the left direction is indicated by the arrow L.

The vehicle body 2 has an engine compartment 11, the cab 10, a pair of drive units 12, and so forth. An engine is installed in the engine compartment 11. The cab 10 and equipment such as hydraulic pumps (not shown) are disposed to the rear of the engine compartment 11. The drive units 12 each have a crawler belt 12*a*. The pipe layer 1 travels when the crawler belts 12*a* are driven by the drive force from the engine.

The work implement 7 has a counterweight 3, a boom 4, a hook 5, and a winch device 6.

The counterweight 3 is attached to the right side of the vehicle body 2. The boom 4 is attached to the left side of the vehicle body 2. That is, the boom 4 is attached to the opposite side of the vehicle body 2 from the side where the counterweight 3 is attached. The boom 4 is suspended by a cable that is played out from the winch device 6 (discussed below). The lower portion of the boom 4 is pivotably attached to the vehicle body 2 by a shaft that runs in the longitudinal direction of the vehicle body 2. The hook 5 for picking up a pipe (the load) is hung at the distal end of the boom 4.

The winch device 6 has a boom winch that swings the boom 4 up and down, and a hook winch that moves the hook up and down. A cable pulled out from the boom winch is connected to the boom 4. A cable pulled out from the hook winch is connected to the hook 5.

Cab 10

Figure 2:
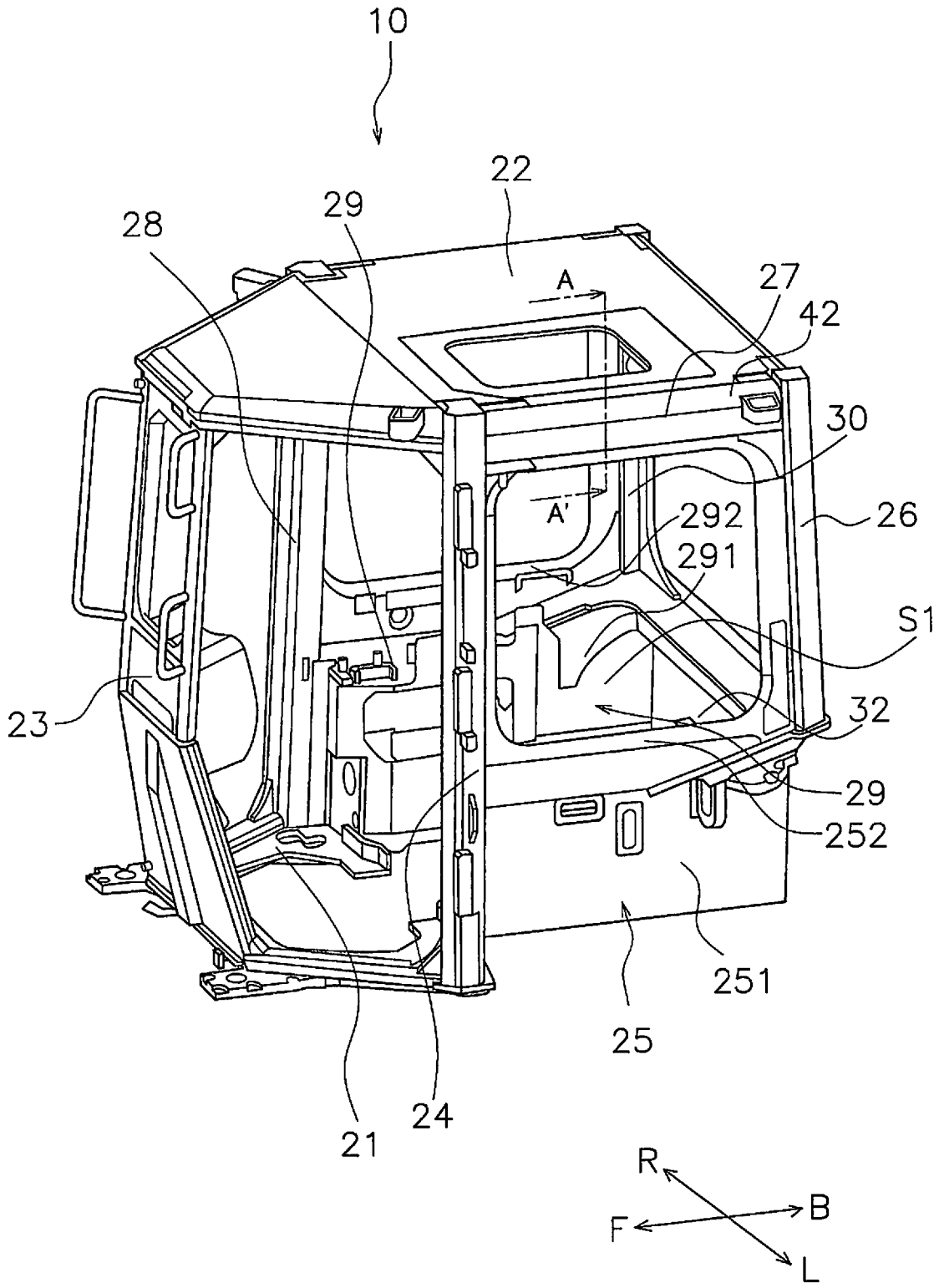
FIG. 2 is an oblique view of the cab in FIG. 1 as viewed from the left side.
Figure 3:
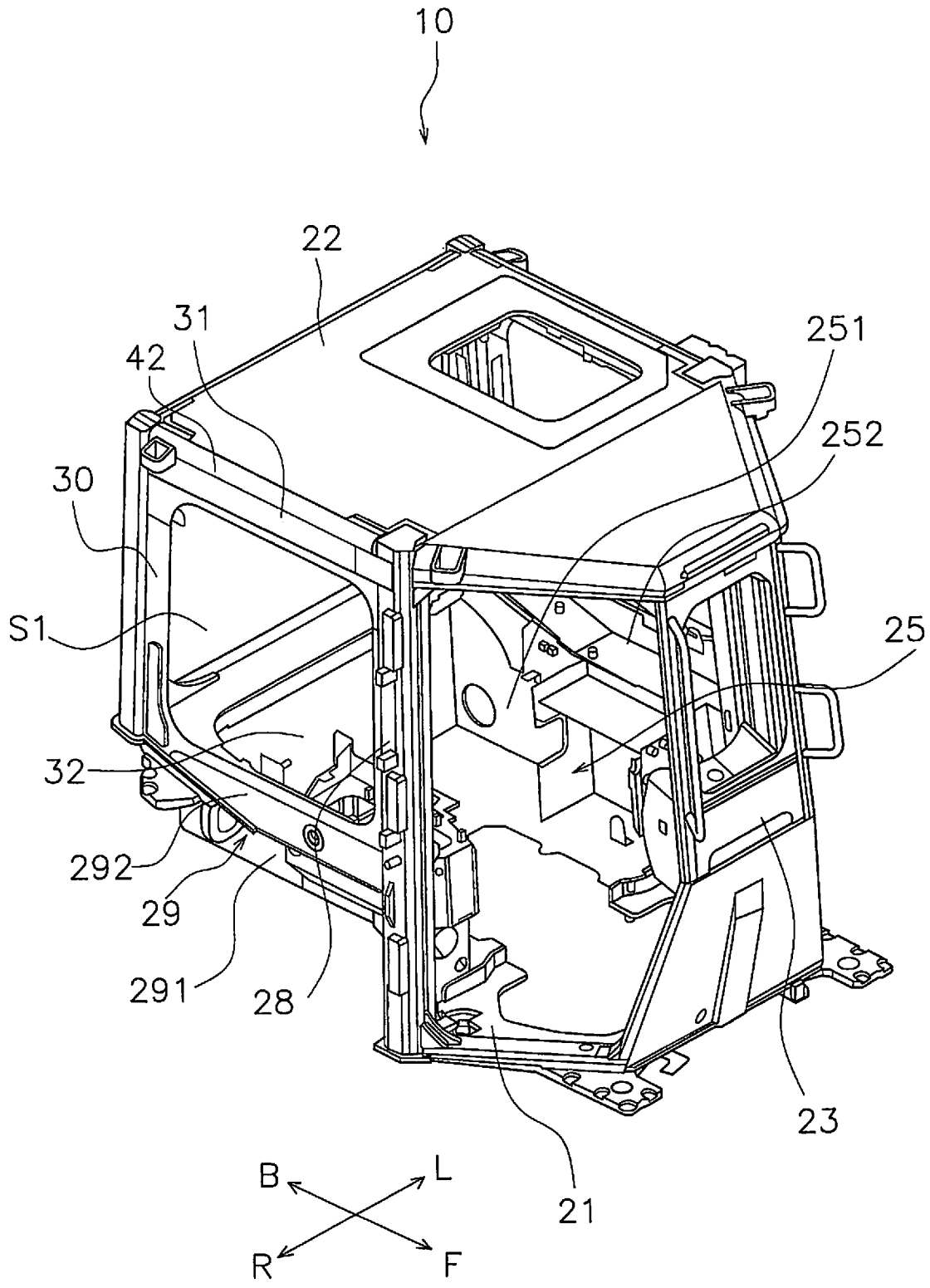
FIG. 3 is an oblique view of the cab in FIG. 1 as viewed from the right side.

FIG. 2 is an oblique view of the cab 10 as viewed from the left side. FIG. 3 is an oblique view of the cab 10 as viewed from the right side.

The cab 10 has an internal space S1, and in this space S1 are disposed a driver's seat, a steering wheel or a joystick lever for steering operation, a lever for operating the boom 4 and the winch device 6, various display devices, and so forth.

The cab 10 has a floor frame 21, a roof 22, a front panel 23, a front pillar 24, a side panel 25, a rear pillar 26, a beam 27, a front pillar 28, a side panel 29, a rear pillar 30, a beam 31, a rear panel 32, and reinforcing members 33 and 34 (see FIGS. 6 and 9 discussed below).

The floor frame 21 is disposed at the periphery of the lower plane of the internal space S1. The roof 22 is substantially pentagonal in plan view, is disposed above the internal space S1, and is opposite the floor frame 21.

The front panel 23 is disposed on the front side of the internal space S1 and connects between the floor frame 21 and the roof 22. The front panel 23 has a window frame at its top portion, in which a window is disposed.

Next, the front pillar 24, the side panel 25, the rear pillar 26, and the beam 27 disposed on the left side of the cab 10 will be described.

The front pillar 24 is disposed to the rear (arrow B) of the front panel 23 and more to the left (arrow L) side than the front panel 23. The front pillar 24 is formed facing upward from the floor frame 21 and is connected to the roof 22. Although not depicted, a door is provided between the front panel 23 and the front pillar 24.

The side panel 25 is disposed to the rear (arrow B) of the front pillar 24 and at the lower portion of the left side face. As shown in FIG. 3, the side panel 25 has a side face 251 formed in the vertical direction, and a horizontal portion 252 formed facing the left direction (arrow L) from the upper end of the side face 251. As shown in FIG. 2, the side face 251 is disposed more to the right side (arrow R) (in other words, to the inside) than the front pillar 24, and the front end of the horizontal portion 252 is connected to the front pillar 24. In this Specification, "horizontal" refers to what would be thought of as horizontal in the colloquial sense, and does not have a strict definition, encompassing, for example, assembly error, mechanical error, and the like. Also, in this Specification, "vertical" refers to what would be thought of as vertical in the colloquial sense, and does not have a strict definition, encompassing, for example, assembly error, mechanical error, and the like.

The rear pillar 26 is formed facing upward from the left-rear corner of the horizontal portion 252 and is connected to the roof 22. Thus, the rear pillar 26 is disposed more to the rear (arrow B) than the front pillar 24. The rear pillar 26 is disposed opposite the front pillar 24 in the longitudinal direction.

The beam 27 is disposed between the front pillar 24 and the rear pillar 26. The beam 27 is welded to the upper end of the front pillar 24 and the upper end of the rear pillar 26 to connect them together, and is also welded to the roof 22. The structure of the beam 27 will be described in detail below.

A window is disposed in the portion surrounded by the front pillar 24, the side panel 25, the rear pillar 26, and the beam 27.

Next, the front pillar 28, the side panel 29, the rear pillar 30, and the beam 31 disposed on the right side of the cab 10 will be described.

As shown in FIG. 3, the front pillar 28 is disposed to the rear (arrow B) of the front panel 23 and more to the right side (arrow R) than the front panel 23. The front pillar 28 is formed facing upward from the floor frame 21 and is connected to the roof 22. Although not depicted, a door is provided between the front panel 23 and the front pillar 28. The front pillar 28 is disposed opposite the front pillar 24 in the left and right direction.

The side panel 29 is disposed to the rear (arrow B) of the front pillar 28 and at the lower portion of the right side face. As shown in FIG. 3, the side panel 29 has a side face 291 formed in the vertical direction, and a horizontal portion 292 formed facing in the right direction (arrow R) from the upper end of the side face 291. The side face 291 is disposed more to the left side (arrow L) (in other words, to the inside) than the front pillar 28, and the front end of the horizontal portion 292 is connected to the front pillar 28.

The rear pillar 30 is formed facing upward from the right-rear corner of the horizontal portion 292, and is connected to the roof 22. Thus, the rear pillar 30 is disposed more to the rear (arrow B) than the front pillar 28. The rear pillar 30 is disposed opposite the front pillar 28 in the longitudinal direction. The rear pillar 30 is disposed opposite the rear pillar 26 in the left and right direction.

The beam 31 is disposed between the front pillar 28 and the rear pillar 30. The beam 31 is welded to the upper end of the front pillar 28 and the upper end of the rear pillar 30 to connect them together, and is also welded to the roof 22. The structure of the beam 31 will be described in detail below.

A window is disposed in the portion surrounded by the front pillar 28, the side panel 29, the rear pillar 30, and the beam 31.

The rear panel 32 is disposed on the rear side of the internal space S1, and connects the floor frame 21 and the roof 22. The rear panel 32 has a window frame on the top of which is disposed a window.

Beam 27, Beam 31

The reinforcing member 33 (FIG. 4; discussed below) is disposed on the beam 27, and the reinforcing member 34 (FIG. 9; discussed below) is disposed on the beam 31.

The internal structures of the beam 27 and the beam 31 are substantially the same, so the beam 27 will be described as an example.

Figure 4:
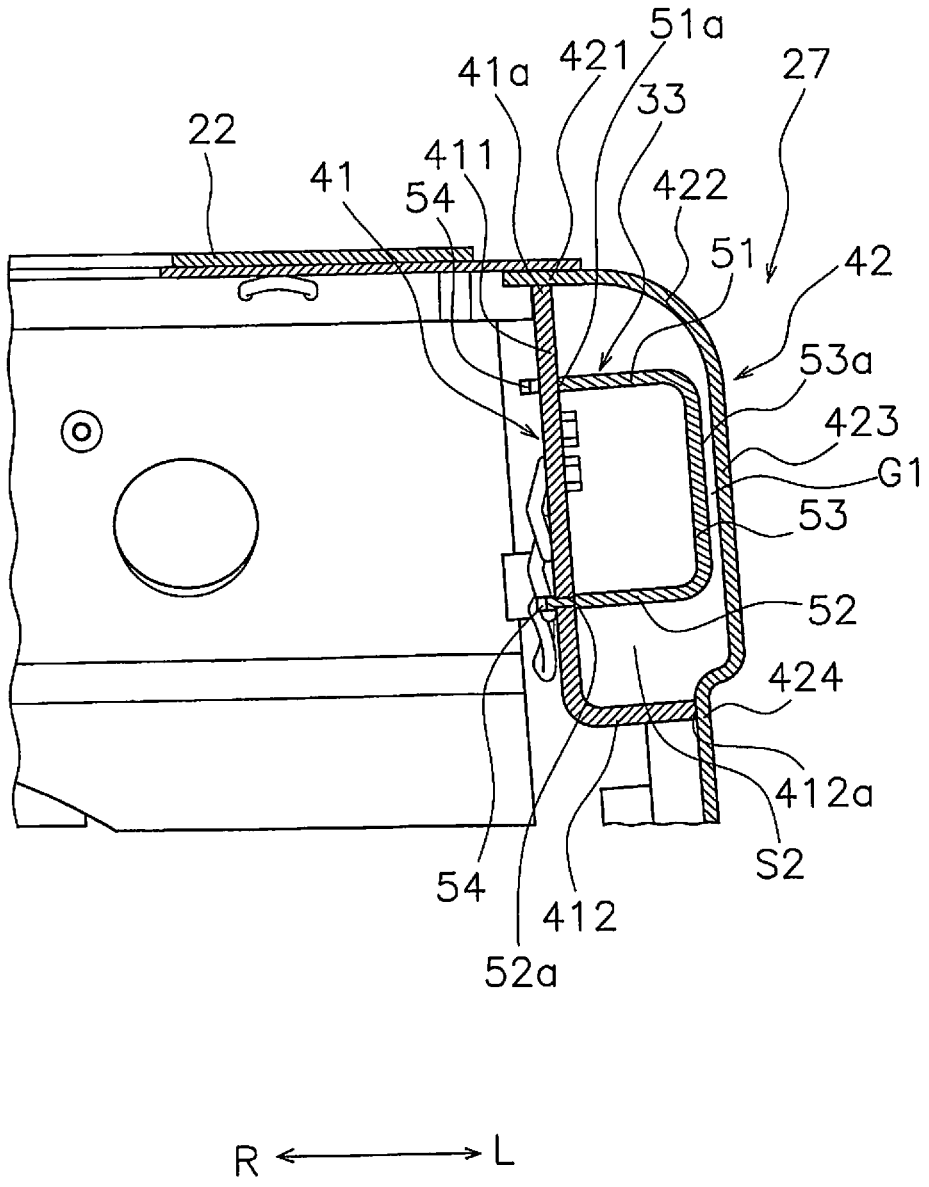
FIG. 4 is a cross section along the A-A' line in FIG. 3.
Figure 5:
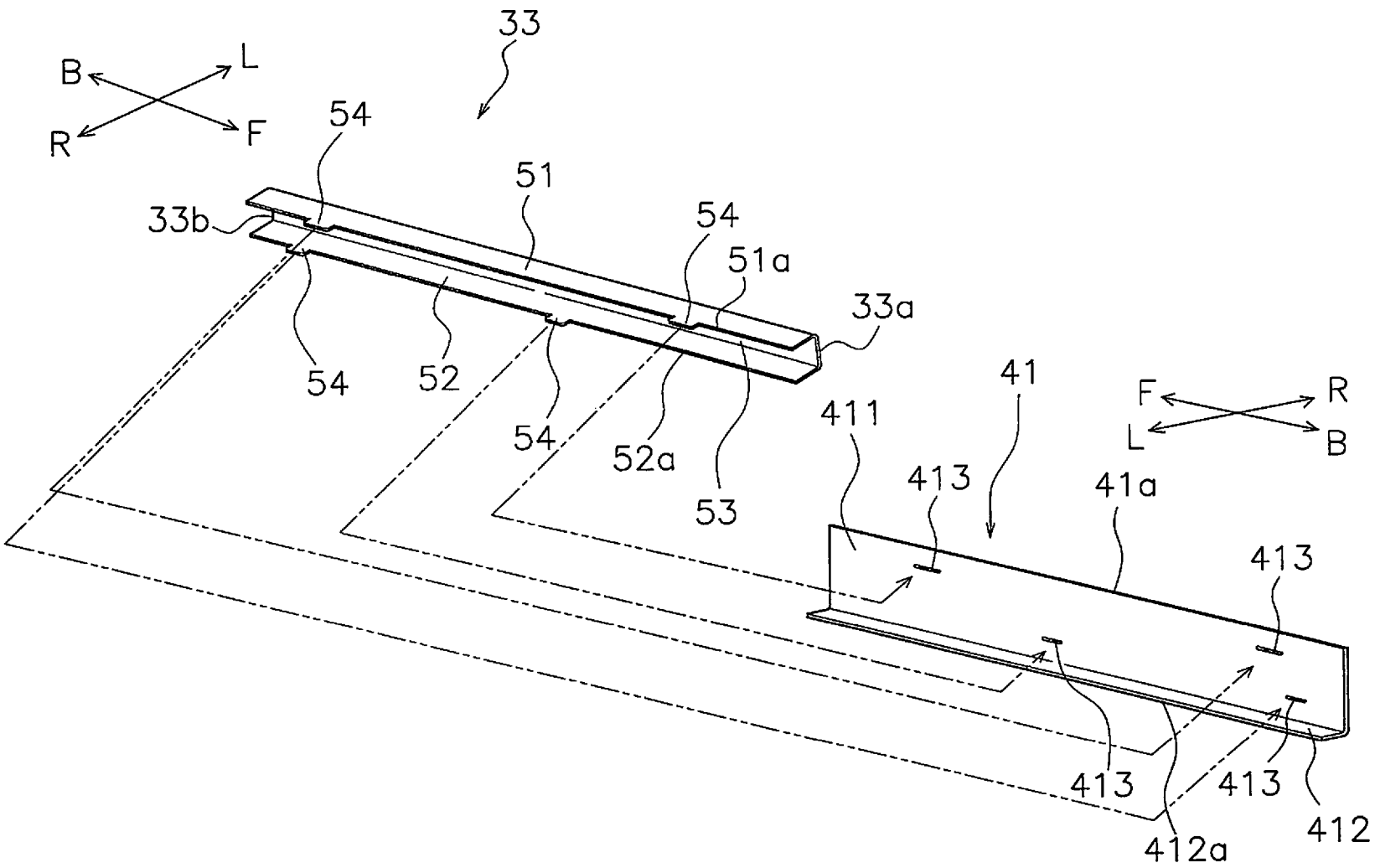
FIG. 5 is the oblique view of an inner plate and reinforcing member in FIG. 4.

FIG. 4 is a cross section along the A-A' line in FIG. 3. As shown in FIG. 4, the beam 27 has an inner plate 41 and an outer plate 42. FIG. 5 is an oblique view of the inner plate 41 and the reinforcing member 33. The inner plate 41 is a member that has an L-shaped cross section, and is formed from a flat stock by stamping or the like. The inner plate 41 has a side wall portion 411 and a horizontal portion 412. The side wall portion 411 is disposed along the vertical direction. The horizontal portion 412 is provided to protrude from the lower end of the side wall portion 411 and facing in the left direction (arrow L) (that is, to the outside).

The side wall portion 411 has a plurality of through-holes 413 formed in it. The through-holes 413 are each in the shape of a slot that is longer in the longitudinal direction.

The outer plate 42 is disposed so as to cover the left side (arrow L) (that is, the outside) of the inner plate 41. The outer plate 42 is formed from a flat stock by stamping or the like. As shown in FIG. 4, the outer plate 42 has a roof portion 421, a curved portion 422, a side wall portion 423, and a connection portion 424.

The roof portion 421 is disposed horizontally and is welded to the upper end 41*a* of the inner plate 41. The side wall portion 423 is disposed on the left side (arrow L) of the side wall portion 411 of the inner plate 41 so as to be opposite the side wall portion 411. The curved portion 422 is convexly curved toward the opposite side from the inner plate 41, so as to connect the end on the left side (arrow L) of the roof portion 421 and the upper end of the side wall portion 423. The connection portion 424 is formed facing downward after being bent in the right direction (arrow R) from the lower end of the side wall portion 423. The face on the right side (arrow R) of the connection portion 424 and the distal end 412*a* of the horizontal portion 412 of the inner plate 41 are welded together.

A space S2 is formed between the inner plate 41 and the outer plate 42 by the inner plate 41 and the outer plate 42 having such shapes.

Reinforcing Members 33 and 34

Since the layout structure of the reinforcing member 33 to the beam 27 and the layout structure of the reinforcing member 33 to the beam 31 are the same, the layout structure of the reinforcing member to the beam 27 will be described as an example.

The reinforcing member 33 is used to reinforce the beam 27, and is disposed along the lengthwise direction (longitudinal direction) of the beam 27. The reinforcing member 33 is fixed to the inner plate 41 and disposed in the space S2. As shown in FIG. 5, the reinforcing member 33 is formed from a flat stock by stamping or the like, and has a first portion 51, a second portion 52, a third portion 53, and a plurality of projecting portions 54.

The first portion 51 is formed from the inner plate 41 toward the outer plate 42, as shown in FIG. 4. The second portion 52 is formed from the inner plate 41 toward the outer plate 42, is parallel to the first portion 51, and is disposed below and opposite the first portion 51. The third portion 53 is formed so as to connect the end on the outer plate 42 side of the first portion 51 and the end on the outer plate 42 side of the second portion 52. The third portion 53 has a flat face 53*a* on the outer plate 42 side, and the flat face 53*a* is formed parallel to the side wall portion 423 of the outer plate 42. In this embodiment, since the third portion 53 is flat, the third portion 53 itself is formed parallel to the side wall portion 423. Also, the flat face 53*a* of the third portion 53 is disposed at a specific gap G1 away from the side wall portion 423. In this Specification, "parallel" refers to what would be thought of as parallel in the colloquial sense, and does not have a strict definition, encompassing, for example, assembly error, mechanical error, and the like.

The plurality of projecting portions 54 are provided at the end 51*a* of the first portion 51 on the opposite side from the third portion 53, and at the end 52*a* of the second portion 52 on the opposite side from the third portion 53, and project toward the opposite side from the outer plate 42. Each of the plurality of projecting portions 54 is formed along the first portion 51 or the second portion 52.

The plurality of projecting portions 54 are formed at positions corresponding to the plurality of through-holes 413, and the projecting portions 54 are inserted into the through-holes 413 (see the dotted arrow in FIG. 5). Thus, in this embodiment, a tenon structure is used, and after the projecting portions 54 have been inserted into the through-holes 413, the projecting portions 54 and the nearby portions of the inner plate 41 are welded to fix the reinforcing member 33 to the inner plate 41.

In a state in which the reinforcing member 33 is fixed to the inner plate 41, the inner plate 41 is disposed between the front pillar 24 and the rear pillar 26, and is welded to the front pillar 24 and the rear pillar 26. After this, the outer plate 42 is disposed so as to cover the reinforcing member 33, and the outer plate 42 and the inner plate 41 are welded together.

Figure 6:
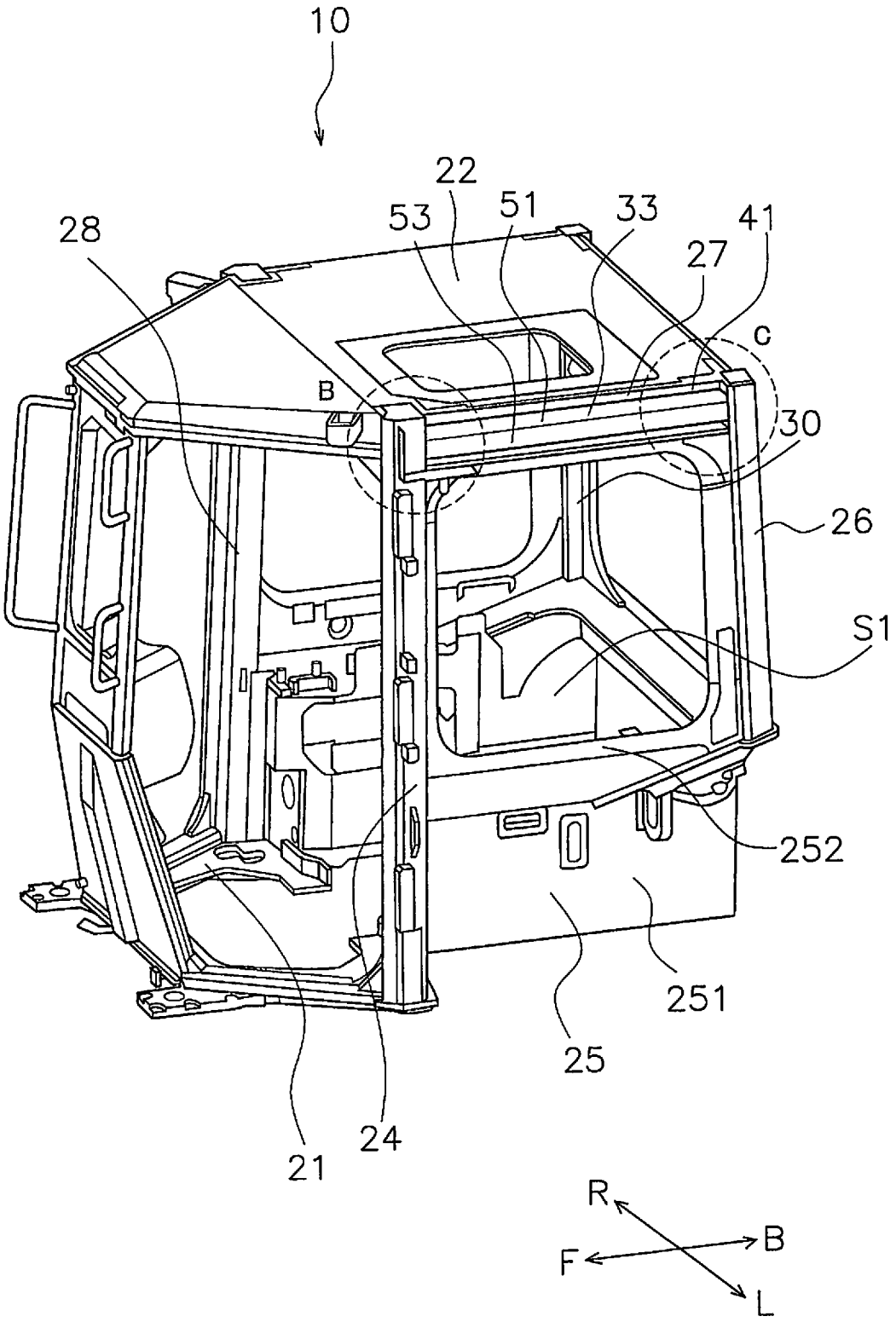
FIG. 6 shows a state in which the outer plate has been removed from the cab of FIG. 2.
Figure 7A:
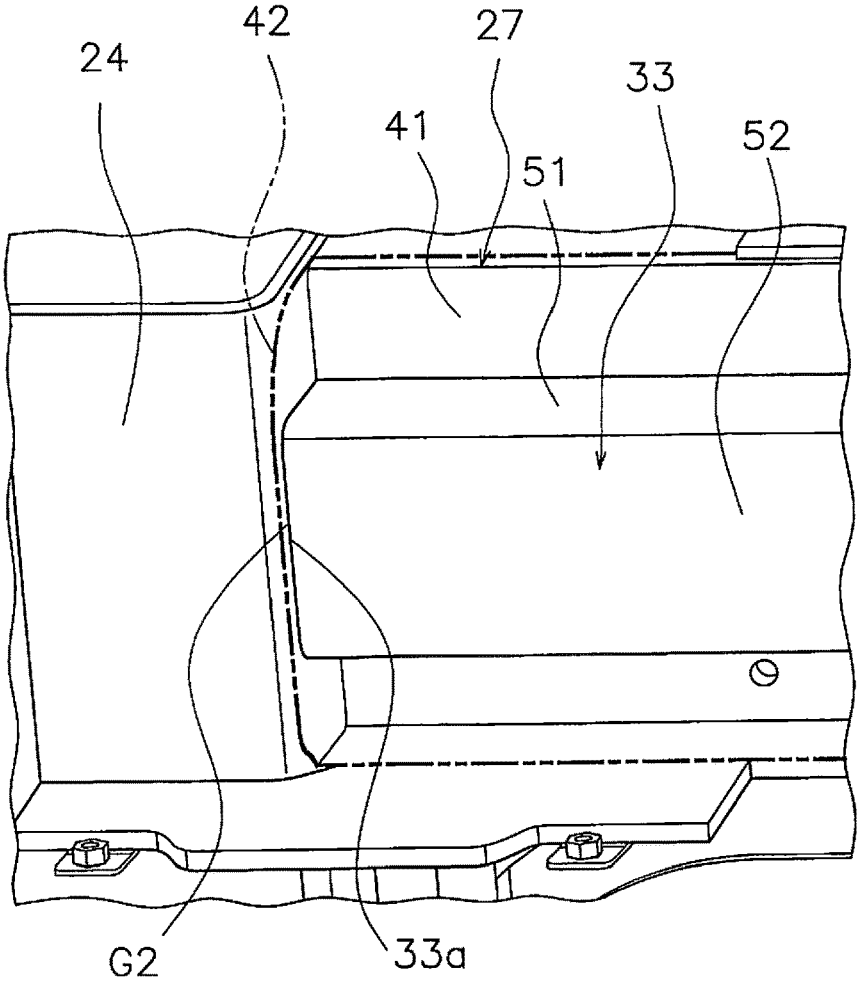
FIG. 7A is a detail view of the B portion in FIG. 6.
Figure 7B:
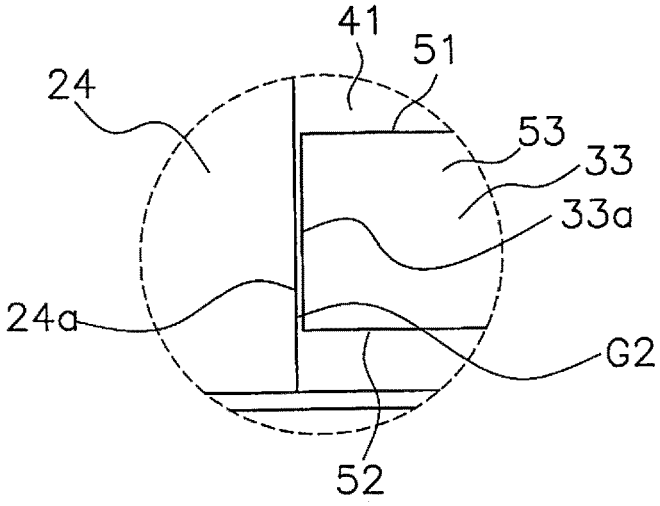
FIG. 7B is a simplified front view of FIG. 7A.
Figure 8A:
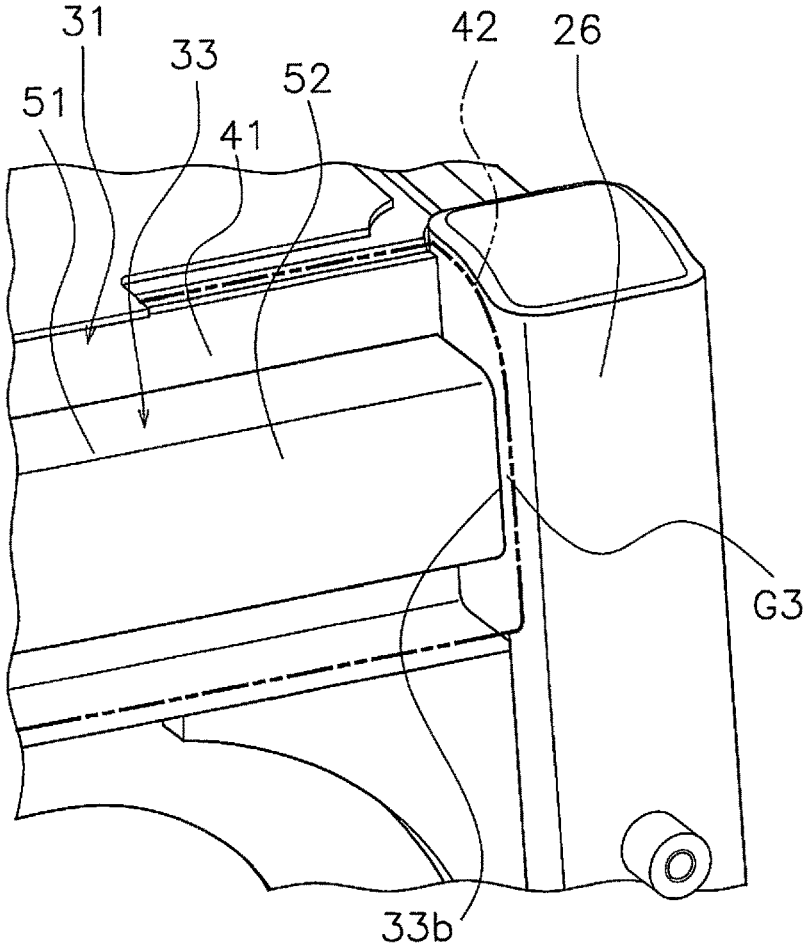
FIG. 8A is a detail view of the C portion in FIG. 6.
Figure 8B:
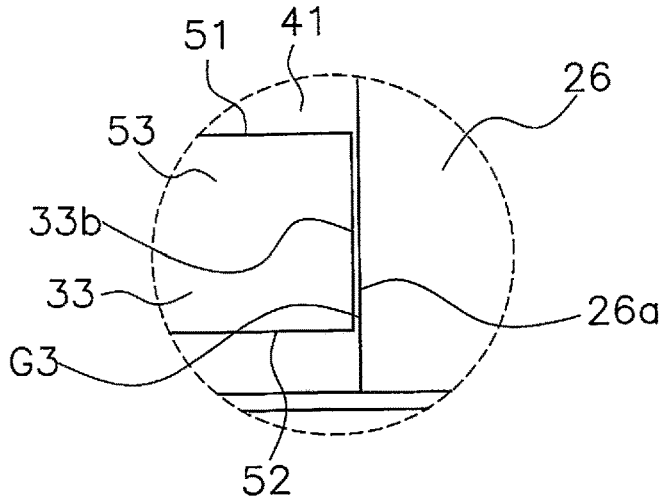
FIG. 8B is a simplified front view of FIG. 8A.

FIG. 6 shows the beam 27 in a state in which the outer plate 42 has been removed. FIG. 7*a* is a detail view of the B portion in FIG. 6. FIG. 7*b* is a simplified front view of FIG. 7*a*, showing a gap G2. FIG. 8*a* is a detail view of the C portion in FIG. 6. FIG. 8*b* is a simplified front view of FIG. 8*a*, showing a gap G3. In FIGS. 7*a* and 8*a*, the outer plate 42 is indicated by a two-dot chain line. In FIGS. 7*b* and 8*b*, the gaps G2 and G3 are shown larger than they really are in order to illustrate the positions of the gaps G2 and G3.

As shown in FIGS. 7*a* and 7*b*, the front end 33*a* of the reinforcing member 33 and the front pillar 24 are not in contact, and a specific gap G2 is formed between the front end 33*a* and the front pillar 24. More precisely, the gap G2 is formed between the front end 33*a* of the reinforcing member 33 and the rear face 24*a* of the front pillar 24. The front end 33*a* includes all the front ends of the first portion 51, the second portion 52 and the third portion 53.

As shown in FIGS. 8*a* and 8*b*, the rear end 33*b* of the reinforcing member 33 and the rear pillar 26 are not in contact with each other, and a specific gap G3 is formed between the rear end 33*b* and the rear pillar 26. More precisely, the gap G3 is formed between the rear end 33*b* of the reinforcing member 33 and the front face 26*a* of the rear pillar 26. The rear end 33*b* includes the rear ends of all of the first portion 51, the second portion 52, and the third portion 53.

Figure 9:
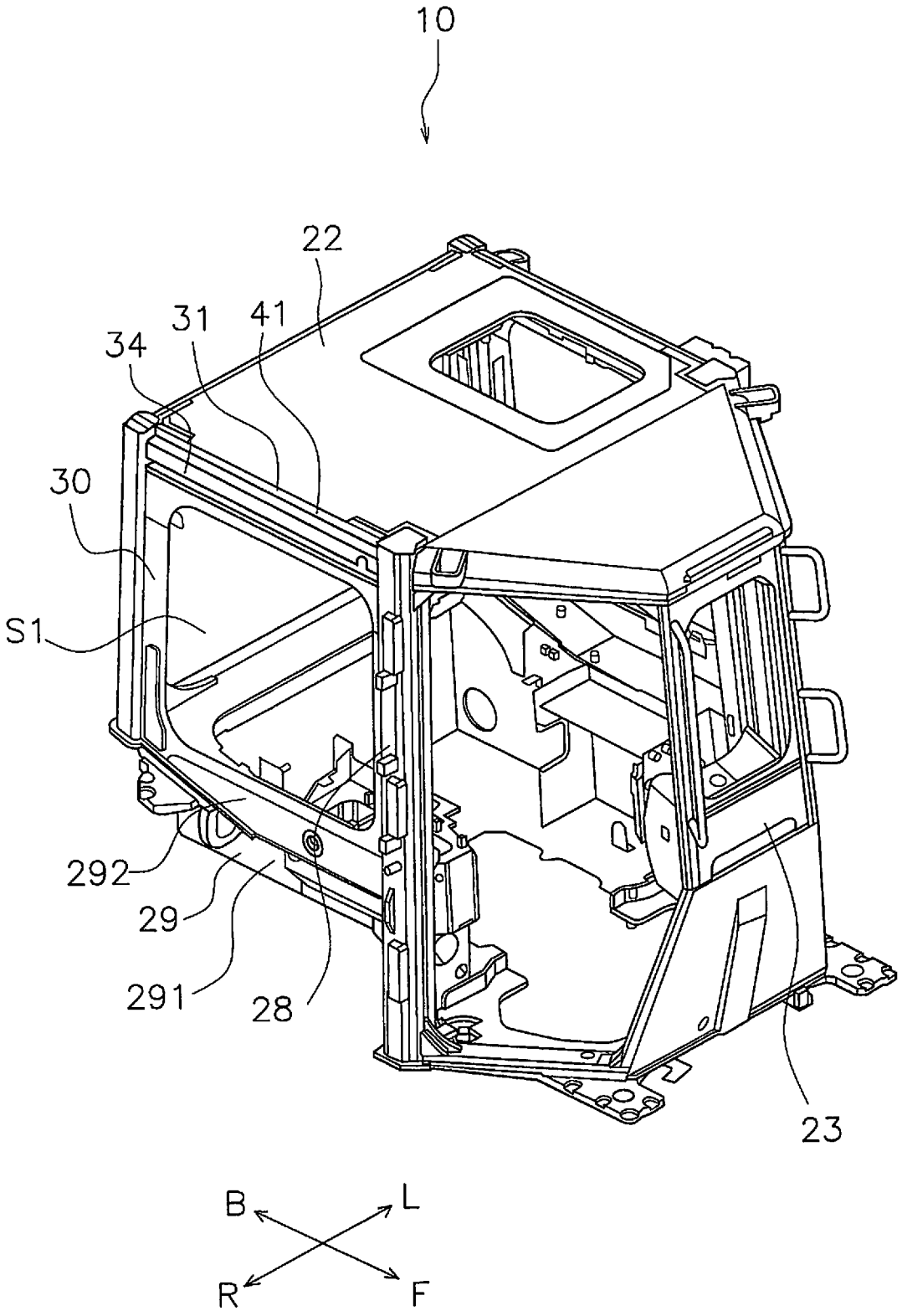
FIG. 9 is a view of a state in which the outer plate has been removed from the cab in FIG. 3.

FIG. 9 shows the beam 31 when the outer plate 42 has been removed. As shown in the drawing, the reinforcing member 34 is attached to the inside of the beam 31. The configurations of the beam 31 and the reinforcing member 34 are substantially the same as the configurations of the beam 27 and the reinforcing member 33, and the reinforcing member 34 is disposed inside the beam 31. The beam 31 has the inner plate 41 and the outer plate 42, and the reinforcing member 34 is fixed to the inner plate 41. The front end of the reinforcing member 34 and the front pillar 28 are not in contact with each other, and a specific gap is formed. Also, the rear end of the reinforcing member 34 and the rear pillar 30 are not in contact with each other, and a specific gap is formed.

Features (1)

The cab 10 in this embodiment is used in a pipe layer 1 (an example of a work machine), and comprises front pillars 24 and 28 (an example of first pillar), rear pillars 26 and 30 (an example of second pillar), beams 27 and 31 (an example of beam), and reinforcing members 33 and 34. The rear pillars 26 and 30 are disposed to the rear of the front pillars 24 and 28. The beam 27 is disposed between the front pillar 24 and the rear pillar 26. The beam 31 is disposed between the front pillar 28 and the rear pillar 30. The reinforcing member 33 is provided to the beam 27. The reinforcing member 34 is provided to the beam 31.

Because the reinforcing members 33 and 34 are thus provided to the beams 27 and 31 of the cab 10, the cab 10 can be used for a pipe layer, a heavy bulldozer, or the like. Also, when used for a lightweight bulldozer or the like, the weight of the cab 10 can be reduced by not attaching the reinforcement members 33 and 34.

As described above, a cab can be provided which can be used in different kinds of work machines and work machines of different sizes.

(2)

With the cab 10 in this embodiment, the beams 27 and 31 have the inner plate 41 and the outer plate 42. The outer plate 42 is disposed outside the inner plate 41. The reinforcing members 33 and 34 are disposed between the outer plate 42 and the inner plate 41 and fixed to the inner plate 41.

Consequently, the outer plate 42 will hit the reinforcing members 33 and 34 if the vehicle should tip over, allowing the strength of the cab 10 to be improved.

(3)

With the cab 10 in this embodiment, the reinforcing members 33 and 34 have the first portion 51, the second portion 52, and the third portion 53. The first portion 51 has a flat shape and is formed from the inner plate 41 toward the outer plate 42. The second portion 52 has a flat shape, is disposed below and opposite the first portion 51, and is formed from the inner plate 41 toward the outer plate 42. The third portion 53 has a flat shape, and connects the distal end on the outer plate 42 side of the first portion 51 and the distal end on the outer plate 42 side of the second portion 52.

As described above, the reinforcing members 33 and 34 are configured to project from the inner plate 41 to the outer plate 42, and the outer plate 42 hits the reinforcing members 33 and 34 in the event of tip-over, so the strength of the cab 10 can be increased.

(4)

With the cab 10 in this embodiment, the reinforcing member 33 is disposed with a gap G2 or G3 between the reinforcing member 33 and at least one of the front pillar 24 and the rear pillar 26. Also, the reinforcing member 34 is disposed with a gap between the reinforcing member 34 and at least one of the front pillar 28 and the rear pillar 30.

Since the reinforcing members 33 and 34 are used to reinforce against external force exerted on the beams 27 and 31 in the event of tip-over, it is preferable for as little as possible of the force received by the pillars to be transmitted. If the force from the pillars were also intended to be received, it would be necessary to further increase the strength of the reinforcing members themselves, resulting in an increase in weight. Therefore, a gap is formed between at least one of the front pillar 24 and the rear pillar 26 and the reinforcing member 33 so that they are not in contact, and a gap is formed between at least one of the front pillar 28 and the rear pillar 30 and the reinforcing member 34 so that they are not in contact, and as a result any force received by the front pillars 24 and 28 or the rear pillars 26 and 30 in the event of tip-over will not be directly transmitted to the reinforcing members 33 and 34.

(5)

With the cab 10 in this embodiment, the third portion 53 has a flat face 53*a* that is opposite the outer plate 42. This allows the impact of external force to be received over the surface, and increases the strength.

(6)

With the cab 10 in this embodiment, the outer plate 42 has a side wall portion 423 (an example of a parallel portion) that is opposite and parallel to the flat face 53*a*. A specific gap G1 is formed between the side wall portion 423 and the flat face 53*a*.

For example, with a design such that the reinforcing members 33 and 34 hit the outer plate 42, if the reinforcing members 33 and 34 project beyond the attachment position of the outer plate 42 due to dimensional error, it may be impossible to attach the outer plate 42. For this reason, even in the case of taking dimensional error into account, dimensional error during manufacture can be dealt with by designing such that a specific gap is produced between the outer plate 42 and the reinforcing members 33 and 34.

(7)

With the cab 10 in this embodiment, through-holes 413 are formed in the inner plate 41. The reinforcing members 33 and 34 have projecting portions 54 provided at the end of the first portion 51 or the second portion 52 on the opposite side from the outer plate 42. The projecting portions 54 are inserted into the through-holes 413.

As described above, using a tenon structure makes manufacturing easier since the inner plate 41 and the projecting portions 54 of the reinforcing members 33 and 34 just need to be welded together.

Also, forming the through-holes 413 in the inner plate 41 to fix the reinforcing members rather than forming through-holes in the outer plate 42 to fix the reinforcing members means that the projecting portions 54 are hidden inside the cab 10, which is preferable aesthetically.

(8)

A pipe layer 1 (an example of a work machine) in this embodiment comprises a cab 10. The cab 10 comprises front pillars 24 and 28 (an example of first pillar), rear pillars 26 and 30 (an example of second pillar), and beams 27 and 31 (an example of beam). The rear pillar 26 is disposed to the rear of the front pillar 24. The rear pillar 30 is disposed to the rear of the front pillar 28. The beam 27 is disposed between the front pillar 24 and the rear pillar 26. The beam 31 is disposed between the front pillar 28 and the rear pillar 30. The beam 27 has the inner plate 41, the outer plate 42, and the reinforcing member 33. The beam 31 has the inner plate 41, the outer plate 42, and the reinforcing member 34. The outer plate 42 is disposed on the outside of the inner plate 41. The reinforcing member 33 is disposed between the outer plate 42 and the inner plate 41, and is fixed to the inner plate 41. The reinforcing member 34 is disposed between the outer plate 42 and the inner plate 41, and is fixed to the inner plate 41.

Thus providing the reinforcing members 33 and 34 to the beams 27 and 31 of the cab 10 allows the cab 10 to be used for a pipe layer, a heavy bulldozer, or the like. Also, when this cab is used for a lightweight bulldozer, etc., the weight of the cab 10 can be reduced by not attaching the reinforcement members 33 and 34.

As described above, a cab can be provided that can be used in different types of work machine and work machines of different sizes.

Other Embodiments

An embodiment of the present invention was described above, but the present invention is not limited to or by the above embodiment, and various modifications are possible without departing from the gist of the invention.

(A)

In the above embodiment, the reinforcing members 33 and 34 are fixed to the inner plate 41, but may instead be fixed to the inner face of the outer plate 42.

(B)

In the above embodiment, the reinforcing members 33 and 34 are fixed to the inner plate 41 by a tenon structure, but the structure is not limited to this. For example, the end 51*a* of the first portion 51 of the reinforcing members 33 and 34 may be bent upward, the end 52*a* of the second portion 52 bent downward, and the bent portions welded to the surface of the inner plate 41.

(C)

In the above embodiment, the reinforcing member 33 is not in contact with either the front pillar 24 or the rear pillar 26, but the force received by the pillars can be released as long as there is no contact with at least one, so the reinforcing members 33 and 34 may be in contact either the front pillar 24 or the rear pillar 26.

The same applies to the reinforcement member 34, which is not in contact with either the front pillar 28 or the rear pillar 30, but it may be in contact with either the front pillar 28 or the rear pillar 30.

(D)

In the above embodiment, the projecting portions 54 are formed on both the end 51*a* of the first portion 51 and the end 52*a* of the second portion 52, but as long as they can be fixed to the inner plate 41, they may be provided to just one of these ends. Also, the number of the projecting portions 54 is not limited to a plurality, and there may be just one as long as the reinforcing members 33 and 34 can be fixed to the inner plate 41.

(E)

In the above embodiment, the reinforcing members 33 and 34 are provided to both the beam 27 on the left side and the beam 31 on the right side, but as long as the ROPS test can be satisfied, the reinforcing members 33 and 34 may be provided to just one of these beams.

(F)

In the above embodiment, a pipe layer was used as an example of the work machine in which the cab 10 of this embodiment was used, but the present invention is not limited to a pipe layer, which may instead be a bulldozer or the like, for example.

The cab of the present invention can be used in a plurality of types and sizes of work machine, and is useful in a pipe layer, a bulldozer, or the like.

What is claimed is:

1. A cab used in a work machine, the cab comprising:
a first pillar;
a second pillar disposed to rear of the first pillar;
a beam disposed between the first pillar and the second pillar; and
a reinforcing member provided to the beam,
the beam including
an inner plate; and
an outer plate disposed on an outside of the inner plate, and
the reinforcing member being disposed between the outer plate and the inner plate and fixed to the inner plate.

2. The cab according to claim 1, wherein the reinforcing member includes
a plate shaped first portion formed from the inner plate toward the outer plate, a plate shaped second portion being opposite the first portion, the plate shaped 20 second portion being formed from the inner plate toward the outer plate, and
a plate shaped third portion connecting a distal end on an outer plate side of the first portion and a distal end on the outer plate side of the second portion.

3. The cab according to claim 1, wherein
the reinforcing member is disposed apart from at least one of the first pillar and the second pillar.

4. The cab according to claim 2, wherein
the third portion includes a flat surface opposite the outer plate.

5. The cab according to claim 4, wherein
the outer plate includes a parallel portion opposite the flat surface and parallel to the flat surface, and
a specific spacing is formed between the parallel portion and the flat surface.

6. The cab according to claim 3, wherein
a through hole is formed in the inner plate,
the reinforcing member further includes a protrusion provided at an end of the first portion or the second portion on an opposite side from the outer plate, and
the protrusion is inserted into the through hole.

7. A work machine comprising:
a cab, the cab including
a first pillar;
a second pillar disposed to a rear of the first pillar; and
a beam disposed between the first pillar and the second pillar, and the beam including
an inner plate,
an outer plate disposed on an outside of the inner plate, and
a reinforcing member disposed between the outer plate and the inner plate, the reinforcing member being fixed to the inner plate.

* * * * *